United States Patent [19]

Reinert et al.

[11] Patent Number: 4,950,304

[45] Date of Patent: Aug. 21, 1990

[54] PROCESS FOR QUENCHING OR SUPPRESSING THE FLUORESCENCE OF SUBSTRATES TREATED WITH FLUORESCENT WHITENING AGENTS

[75] Inventors: Gerhard Reinert, Allschwil; Kurt Burdeska, Basel, both of Switzerland

[73] Assignee: Ciba-Geigy Corporation, Ardsley, N.Y.

[21] Appl. No.: 248,076

[22] Filed: Sep. 23, 1988

[30] Foreign Application Priority Data

Oct. 2, 1987 [CH] Switzerland ..... 3856/87

[51] Int. Cl.[5] ..... D06L 3/12; D06M 13/34; D06P 1/62; C09B 67/00

[52] U.S. Cl. ..... 8/566; 8/573; 8/589; 8/648; 8/917; 8/924; 8/128.3

[58] Field of Search ..... 8/566, 573, 589

[56] References Cited

U.S. PATENT DOCUMENTS

| | | | |
|---|---|---|---|
| 4,313,732 | 2/1987 | Teague et al. | 8/541 |
| 4,668,235 | 5/1987 | Evans et al. | 8/115.58 |
| 4,698,064 | 10/1987 | Evans et al. | 8/128 R |
| 4,770,667 | 9/1988 | Evans et al. | 8/128.1 |

FOREIGN PATENT DOCUMENTS

| | | |
|---|---|---|
| 46-029470 | 8/1971 | Japan . |
| WO84/02365 | 6/1984 | PCT Int'l Appl. . |
| WO86/03528 | 6/1986 | PCT Int'l Appl. . |
| 2174731A | 11/1986 | United Kingdom . |

OTHER PUBLICATIONS

Chem. Abstract, 77, 36262r (1972).

H. Gold in Venkataraman's "The Chemistry of Synthetic Dyes," vol. V, (Academic Press), 1971, p. 536.

*Primary Examiner*—A. Lionel Clingman

*Attorney, Agent, or Firm*—George R. Dohmann; Edward McC. Roberts

[57] ABSTRACT

There is disclosed a process for quenching or suppressing the fluorescence of natural or synthetic polyamide substrates treated, or to be treated, with fluorescent whitening agents, which process comprises applying to said substrates, before or after the treatment with the fluorescent whitening agent, a sulfonated UV absorber of formula

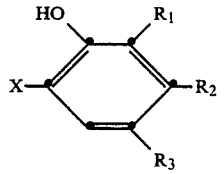

(1)

wherein X, $R_1$, $R_2$ and $R_3$ are as defined in claim 1, and fixing said UV absorber thereon.

8 Claims, No Drawings

PROCESS FOR QUENCHING OR SUPPRESSING THE FLUORESCENCE OF SUBSTRATES TREATED WITH FLUORESCENT WHITENING AGENTS

The present invention relates to a process for quenching or suppressing the fluorescence of natural or synthetic polyamide substrates treated, or to be treated, with florescent whitening agents, by the application of UV absorbers, and to the material so treated.

Processes for quenching the fluorescence of whitened substrates are known. Thus, for example, UK patent application GB-A-No. 2,174,731 teaches a process for quenching or preventing white effects on different substrates by the application of UV absorbers, in which process the UV absorbers employed are derivatives of the benzophenone series or of the unsulfonated benzotriazoles series.

It has now been found that sulfonated 2-hydroxyphenylbenzotriazoles and 2-hydroxyphenyl-s-triazines are most suitable for quenching or suppressing the fluorescent effects produced on substrates by treatment with fluorescent whitening agents.

Accordingly, the invention relates to a process for quenching or suppressing the fluoroescence of natural or synthetic polyamide substrates treated, or to be treated, with fluoroescent whitening agents, which process comprises applying to said substrates, before or after the treatment with the fluorescent whitening agent, a sulfonated UV absorber of formula

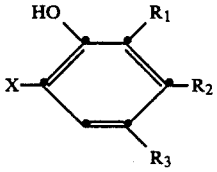

(1)

wherein $R_1$ is hydrogen, halogen, $C_1$–$C_{12}$-alkyl, $C_5$–$C_6$-cycloalkyl, $C_7$–$C_9$-phenylalkyl or sulfo, $R_2$ is hydrogen, $C_1$–$C_4$-alkyl, $C_1$–$C_4$-alkoxy, halogen, hydroxy or sulfo, $R_3$ is hydrogen, $C_1$–$C_{12}$-alkyl, $C_1$–$C_4$-alkoxy, phenyl, $C_1$–$C_8$-alkylphenyl, $C_5$–$C_6$-cycloalkyl, $C_2$–$C_9$-alkoxycarbonyl, halogen, carboxy-$C_1$–$C_4$-alkyl, $C_2$–$C_9$-phenylalkyl or sulfo and X is a radical of formula

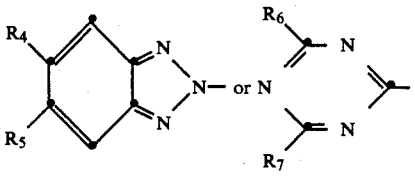

wherein $R_4$ is hydrogen, halogen, $C_1$–$C_4$-alkyl, $C_1$–$C_4$-alkoxy, $C_2$–$C_9$-alkoxycarbonyl, carboxy or sulfo, $R_5$ is hydrogen or halogen and $R_6$ and $R_7$ are each independently of the other $C_1$–$C_4$-alkyl, $C_1$–$C_4$-alkoxy, $C_5$–$C_6$-cycloalkyl, phenyl or phenyl which is substituted by $C_1$–$C_4$-alkyl and hydroxy, and fixing said UV absorber thereon.

Suitable UV absorbers of formula (1) are (A) 2-phenylbenzotriazoles of formula

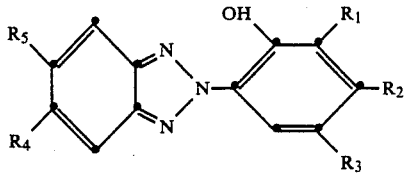

(2)

wherein $R_1$ is hydrogen, $C_1$–$C_{12}$-alkyl, chlorine, $C_5$–$C_6$-cycloalkyl, $C_7$–$C_9$- phenylalkyl or sulfo, $R_2$ is hydrogen, $C_1$–$C_4$-alkyl, $C_1$–$C_4$-alkoxy, chlorine, hydroxy or sulfo, $R_3$ is $C_1$–$C_{12}$-alkyl, $C_1$–$C_4$ alkoxy, phenyl, $C_1$–$C_8$-alkylphenyl, $C_5$–$C_6$-cycloalkyl, $C_2$–$C_9$-alkoxycarbonyl, chlorine, carboxyethyl or $C_7$–$C_9$-phenylalkyl or sulfo, $R_4$ is hydrogen, chlorine, $C_1$–$C_4$-alkyl, $C_1$–$C_4$-alkoxy, $C_2$–$C_9$-alkoxycarbonyl, carboxy or sulfo and $R_5$ is hydrogen or chlorine, the carboxy or sulfo groups of which compounds may also be in salt form, for example in the form of alkali metal salts, alkaline earth metal salts, ammonium salts or amine salts. Examples of compounds of formula (2) are the sodium salt of 3-(2'H-benzotriazol-2'-yl)-5-tert-butyl-4-hydroxybenezenesulfonic acid, 3-(2'H-5'-chlorobenzotriazol-2'-yl)-5-tert-butyl-14-hydroxybenzenesulfonic acid, and 3-(2'H-benzotriazol-2'-yl)-5-sec-butyl-4-hydroxybenzenesulfonic acid, and (B) 2-phenyl-s-triazines of formula

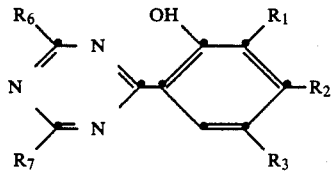

(3)

wherein $R_1$ is hydrogen, halogen, $C_1$–$C_4$-alkyl or sulfo, $R_2$ is hydrogen, $C_1$–$C_4$-alkyl, $C_1$–$C_4$-alkoxy or hydroxy, $R_3$ is hydrogen or sulfo and $R_6$ and $R_7$ are each independently of the other $C_1$14 $C_4$-alkyl, $C_1$–$C_4$-alkoxy, $C_5$–$C_6$-cycloalkyl, phenyl or phenyl which is substituted by $C_1$–$C_4$-alkyl and hydroxy, the sulfo groups of which compounds may be in the free or in salt form, for example in the form of alkali metal salts, alkaline earth metal salts, ammonium salts or amine salts. Examples of compounds of formula (3) are the sodium salt of 3-(4',6'-diphenyl-s-triazin-2'-yl)-4-hydroxy-6-methoxybenzenesulfonic acid, 3-(4',6'-diphenyl-s-triazin-2'-yl)-4-hydroxy-6-ethoxybenzenesulfonic acid and 3-(4',6'-diphenyl-s-triazin-2'-yl)-4-hydroxy-6-propoxybenzenesulfonic acid.

The above compounds of formulae (1) to (3) are disclosed, for example, in WO-A- No. 84/02365 and WO-A- No. 86/03528 and can be prepared by known methods.

Mixtures of UV absorbers can also be used.

The UV absorber is preferably applied to the substrate from an aqueous medium.

In the process of this invention, the UV absorber can be applied to the substrate and fixed thereon by all known methods of dyeing or printing, for example by treatment in a long bath in the temperature range from 20° to 140° C., by impregnation and batching at room temperature or elevated temperature, for example in the range from 20° to 90° C. for 30 minutes to 48 hours, depending on the temperature, by padding and fixing by treatment with saturated steam, superheated steam, hot air, or by treatment with high frequency or contact heat. The UV absorber can also be applied by heat transfer printing. The UV absorber can further be fixed on the substrate in combination with organic polymers, for example in the form of aqueous or non-aqueous surface coatings, or by the method of pigment printing.

The method of applying and fixing the UV absorber and the amount of UV absorber employed depends on the substrate, the dye used, the florescent whitening agents and their fastness properties, and on the properties of the UV absorber. In general, good quenching effects are obtained when the UV absorber is used in an amount of 0.1 to 5% by weight, based on the weight of the substrate.

As already mentioned, the UV absorber can be applied after treatment with a fluorescent whitening agent or before, during or after dyeing or printing a substrate treated with a fluorescent whitening agent. Treatment with the UV absorber can also be effected before, during or after dyeing or printing, before the substrate is treated with a fluorescent whitening agent. This last mentioned procedure is used, for example, for treating articles of clothing which are washed after use. At the present time, commercial detergents and soaps for domestic use usually contain fluorescent whitening agents to impart a whiter appearance to the washed articles. When textiles which have been dyed or printed in a light shade are washed with such a detergent composition, the shade after drying is different from what it was previously, especially in the case of light shades such as blue, pink and beige.

Depending on the particular process, the white effects are quenched or suppressed locally or over the whole area of the substrate. These white effects are produced with commercially available fluorescent whitening agents, for example the known anionic or cationic fluorescent whitening agents and disperse fluorescent whitening agents used in detergent compositions. Exemplary of such fluorescent whitening agents are derivatives of bis(triazinylamino)stilbenedisulfonic acid, triazolyl derivatives of stilbenesulfonic acids, bis(-stilbene) compounds, pyrazoline, coumarin, bis(benzimidazolyl), bis(oxazolyl), naphthalimide, cyanine, benzoxazolyl and oxacyanine derivatives.

The terms "substrates" will be understood as meaning textile materials made of natural or synthetic polyamides, by which are meant in turn, for example, yarns, wovens, knits or nonwovens. The textile materials can also consist of blends of polyamides with other fibres.

The invention is illustrated by the following non-limitative Examples.

EXAMPLE 1

Two pieces of nylon tricot, each of 20 g, are dyed at a liquor to goods ratio of 1:30, with the addition of 1% of 80% acetic acid and 0.5 g/l of the adduct of 10.5 mol of ethylene oxide and 1 mol of nonyl phenol, with 0.0075% of the dye of formula I

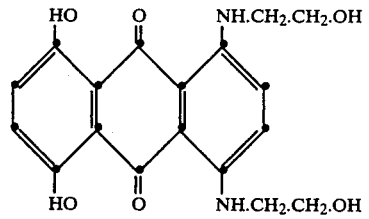

(I)

without (sample A) and with (sample B) 1% of the compound of formula II

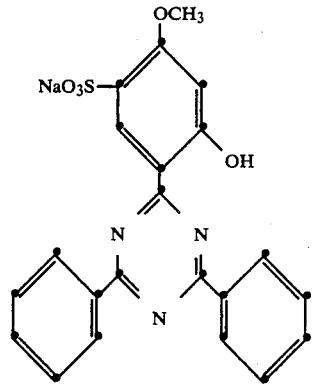

(II)

The fabric is put into each liquor at 50° C., the temperature is raised to 90° C. over 20 minutes, and dyeing is carried out for 45 minutes. The samples are then rinsed with cold water and dried at 80° C.

Each sample is divided into three samples, two of which are washed. The third is used for comparison purposes. Washing is carried out at 40° C. for 30 minutes at a liquor to goods ratio of 1:20 with 4 g/l of TOTAL® detergent (concentration of fluorescent whitening agent: 0.22%) and 4 g/l of WOOLITE® detergent (concentration of fluorescent whitening agent: 0.07%) respectively. The results are reported in Table I:

TABLE 1

| | UNWASHED | with TOTAL ® | with WOOLITE ® |
|---|---|---|---|
| SAMPLE $A_{1-3}$ | greenish turquoise | reddish turquoise strong fluorescence | reddish turquoise strong fluorescence |
| SAMPLE $B_{1-3}$ | greenish turquoise | greenish turquoise | greenish turquoise |

In contrast to samples A, the shade of samples B remains unchanged.

EXAMPLE 2-4

The procedure of Example 1 is repeated, using the dyes of formulae III, IV and V (III)

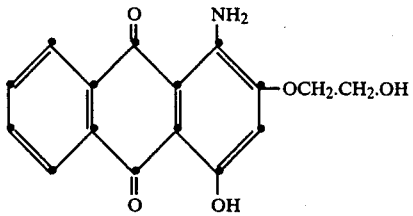

amount used: 0.01%

(IV)

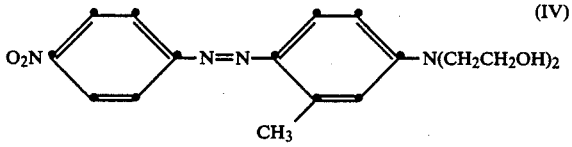

amount used: 0.0075%

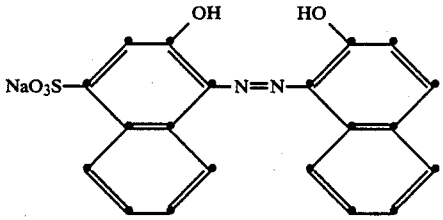

1:2 Cr-complex
amount used: 0.01%

+

(V)

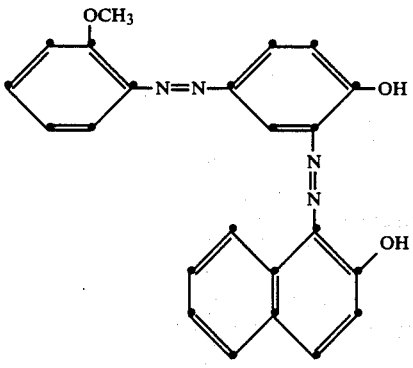

A similar result is obtained in each case, i.e. the samples containing the compound of formula II remain virtually unchanged in shade, whereas the dyeing obtained without compound II undergo changes in shade.

EXAMPLE 5–7

In accordance with the procedure described in Example 1, dyeings are obtained using 0.0075% of dye of formula I with and without UV absorber. Compounds of formula (VI)

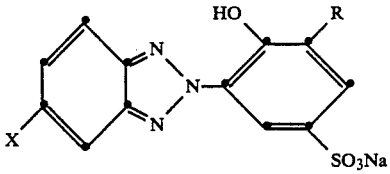

wherein

| Compound | X | R |
|---|---|---|
| (VII) | H | $-C(CH_3)_3$ |
| (VIII) | Cl | $-C(CH_3)_3$ |
| (IX) | H | $-CH(CH_3)-CH_2-CH_3$ |

are used as UV absorbers.

The dyed samples A (without UV absorber) and B (each containing 1% of compounds VII, VIII and IX) as described in Example 1 are divided into portions which are washed with TOTAL ® and WOOLITE ® detergents. The results are reported in Table II:

TABLE II

| DYEING with DYE (I) | | APPEARANCE OF THE DYEINGS | | |
|---|---|---|---|---|
| | | UNWASHED | WASHED with TOTAL ® | WASHED with WOOLITE ® |
| 5–7 A | without UV absorber | greenish turquoise | reddish turquoise fluorescence | strong reddish turquoise fluorescence |
| 5B | with UV absorber VII | greenish turquoise | greenish turquoise (no fluorescence) | greenish turquoise (no fluorescence) |
| 6B | with UV absorber VIII | greenish turquoise | | |
| 7B | with UV absorber IX | greenish turquoise | | |

When washed, all samples containing UV absorber exhibit no changes in shade.

EXAMPLE 9

The procedures described in Examples 1 and 2 are repeated, i.e. two dyeings are produced with 0.01% of the dye of formula II without and with 1% of the UV absorber of formula VII. When the dyed samples so obtained are washed with the detergents containing fluorescent whitening agent, the conventional dyeings exhibit a pronounced change of shade to brilliant violet, whereas the dyeings containing compound VII are virtually unchanged in shade.

EXAMPLE 10

Two pieces of bleached wool muslin, each of 20 g, are dyed with and without UV absorber. The dye liquors contain 2% of ammonium sulfate, 2% of the sulfonated polyadduct of naphthalene and formaldehyde, and 0.005% of the dye of formula X. Liquor A contains no further ingredients, whereas liquor B additionally contains 1% of the UV absorber of formula IX

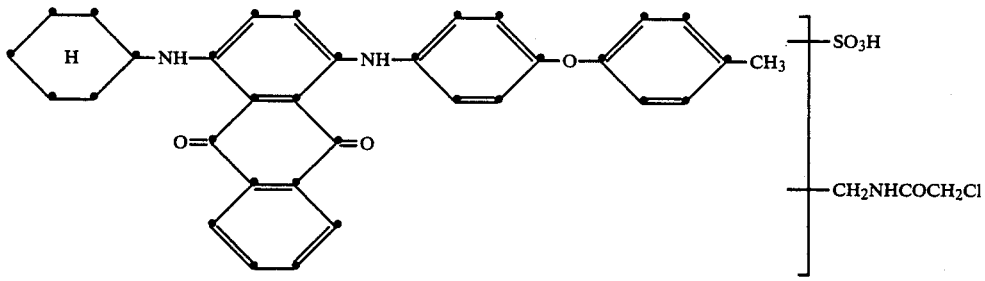

(X)

The liquor to goods ratio is 1:50 and the goods are put into the liquor at 50° C. The dye liquor is heated to 95° C. over 45 minutes and afterwards the goods are thoroughly rinsed cold, centrifuged, and dried at 80° C.

The washing tests are carried out as described in Example 1.

The sample conventionally dyed (in liquor A) undergoes a marked change of shade when washed with a detergent which contains fluorescent whitening agent: the dyeing is redder and more brilliant. In contrast, the sample dyed in liquor B remains unchanged and also exhibits no fluorescence in UV light as compared with the first sample.

EXAMPLE 11

The procedure described in Example 10 is repeated, using 0.015% of the dye of formula V. When washed in washing liquors containing fluorescent whitening agents, the dyed samples differ in behaviour: the shade of the sample containing UV absorber remains unchanged, whereas that of the sample dyed conventionally is redder and more brilliant.

What is claimed is:

1. A process for quenching or suppressing the fluorescence of natural or synthetic polyamide substrates treated, or to be treated, with fluorescent whitening agents, which process comprises applying to said substrates, before or after the treatment with the fluorescent whitening agent, the step of applying a liquor containing at least 1% of

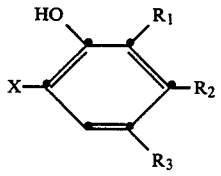

(1)

wherein $R_1$ is hydrogen, halogen, $C_1$–$C_{12}$-alkyl, $C_5$–$C_6$-cycloalkyl, $C_7$–$C_9$-phenylalkyl or sulfo.

$R_2$ is hydrogen, $C_1$–$C_4$-alkyl, $C_1$–$C_4$-alkoxy, halogen, hydroxy or sulfo, $R_3$ is hydrogen, $C_1$–$C_{12}$-alkyl, $C_1$–$C_4$-alkoxy, phenyl, $C_1$–$C_8$-alkylphenyl, $C_5$–$C_6$-cycloalkyl, $C_2$–$C_9$-alkoxycarbonyl, halogen, carboxy-$C_1$–$C_4$-alkyl, $C_2$–$C_9$-phenylalkyl or sulfo, and X is a radical of formula

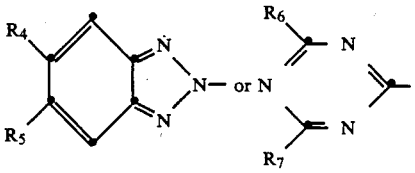

wherein $R_4$ is hydrogen, halogen, $C_1$–$C_4$-alkyl, $C_1$–$C_4$-alkoxy, $C_2$–$C_9$-alkoxycarbonyl, carboxy or sulfo, $R_5$ is hydrogen or halogen and $R_6$ and $R_7$ are each independently of the other $C_1$–$C_4$-alkyl, $C_1$–$C_4$-alkoxy, $C_5$–$C_6$-cycloalkyl, phenyl or phenyl which is substituted by $C_1$–$C_4$-alkyl and hydroxy, and fixing said UV absorber thereon.

2. A process according to claim 1, which comprises applying a 2-phenylbenzenetriazole, or a salt thereof, of formula

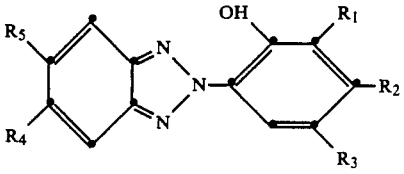

(2)

as UV absorber, wherein $R_1$ is hydrogen, $C_1$–$C_{12}$-alkyl, chlorine, $C_5$–$C_6$-cycloalkyl, $C_7$–$C_9$-phenylalkyl or sulfo.

$R_2$ is hydrogen, $C_1$–$C_4$-alkyl, $C_1$–$C_4$-alkoxy, chlorine, hydroxy or sulfo, $R_3$ is $C_1$–$C_{12}$-alkyl, $C_1$–$C_4$-alkoxy, phenyl, $C_1$–$C_8$-alkylphenyl, $C_5$–$C_6$-cycloalkyl, $C_2$–$C_9$-alkoxycarbonyl, chlorine, carboxyethyl or $C_7$–$C_9$-phenylalkyl or sulfo, $R_4$ is hydrogen, chlorine, $C_1$–$C_4$-alkyl, $C_1$–$C_4$-alkoxy, $C_2$–$C_9$-alkoxycarbonyl, carboxy or sulfo, and $R_5$ is hydrogen or chlorine.

3. A process according to claim 2, which comprises applying the sodium salt of 3-(2'-H-benzotriazol-2'-yl)-5-tert-butyl-4-hydroxybenzenesulfonic acid, 3-(2'H-5'-chlorobenzotriazol-2'-yl)-5-butyl-4-hydroxybenzenesulfonic acid or 3-(2'H-benzotriazol-2'-yl)-5-sec-butyl-4-hydroxy benzenesulfonic acid, 4. A process according to claim 1, which comprises applying a 2-phenyl-s-triazine, or a salt thereof, of formula

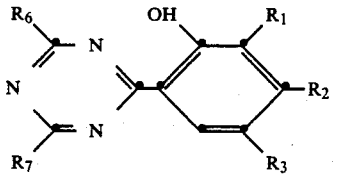

(3)

as UV absorber, wherein $R_1$ is hydrogen, halogen, $C_1$–$C_4$-alkyl or sulfo, $R_2$ is hydrogen, $C_1$–$C_4$-alkyl, $C_1$–$C_4$-alkoxy or hydroxy, $R_3$ is hydrogen or sulfo, and $R_6$ and $R_7$ are each independently of the other $C_1$–$C_4$-alkyl, $C_1$–$C_4$-alkoxy, $C_5$–$C_6$-cycloalkyl, phenyl or phenyl which is substituted by $C_1$–$C_4$-alkyl and hydroxy.

5. A process according to claim 4, which comprises applying the sodium salt of 3-(4′,6′-diphenyl-s-triazin-2′-yl)-4-hydroxy-6-methoxybenzenesulfonic acid, 3-(4′,6′-diphenyl-s-triazin-2′-yl)-4-hydroxy-6-ethoxybenzenesulfonic acid or 3-(4′,6′-diphenyl-s-triazin-2′-yl)-4-hydroxy-6-propoxybenzenesulfonic acid.

6. A process according to claim 1, wherein the UV absorber is applied to the substrate before treatment with the fluorescent whitening agent and fixed thereon.

7. A process according to claim 1, wherein the UV absorber is applied to the substrate before, during or after dyeing or printing said substrate.

8. The natural or synthetic polyamide substrate treated by the process as claimed in claim 1.

* * * * *